US008456385B2

(12) United States Patent
Kojima et al.

(10) Patent No.: US 8,456,385 B2
(45) **Date of Patent: *Jun. 4, 2013**

(54) DISPLAY APPARATUS AND DISPLAY DRIVING METHOD FOR ENHANCING GRAYSCALE DISPLAY CAPABLE OF LOW LUMINANCE PORTION WITHOUT INCREASING DRIVING TIME

(75) Inventors: Ayahito Kojima, Kawasaki (JP); Shinsuke Tanaka, Kawasaki (JP); Shunji Oota, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 422 days.

This patent is subject to a terminal disclaimer.

(21) Appl. No.: 12/727,145

(22) Filed: Mar. 18, 2010

(65) Prior Publication Data

US 2010/0188442 A1 Jul. 29, 2010

Related U.S. Application Data

(63) Continuation of application No. 10/968,930, filed on Oct. 21, 2004, now Pat. No. 7,710,359.

(30) Foreign Application Priority Data

Jan. 14, 2004 (JP) ..... 2004-7033

(51) Int. Cl.
*G09G 3/28* (2006.01)

(52) U.S. Cl.
USPC ..... 345/63; 345/60; 345/38

(58) Field of Classification Search
USPC ..... 345/30–37
See application file for complete search history.

(56) References Cited

U.S. PATENT DOCUMENTS

| | | | | |
|---|---|---|---|---|
| 6,034,656 | A | 3/2000 | Yamamoto et al. | |
| 6,791,516 | B2 | 9/2004 | Kang | |
| 6,809,708 | B2 | 10/2004 | Kanazawa et al. | |
| 7,209,100 | B1 * | 4/2007 | Suzuki | 345/63 |
| 7,271,782 | B2 * | 9/2007 | Yoon et al. | 345/60 |
| 2002/0130825 | A1 | 9/2002 | Kang | |
| 2003/0030655 | A1 | 2/2003 | Ooe et al. | |
| 2003/0043304 | A1 | 3/2003 | Correa et al. | |
| 2004/0125051 | A1 | 7/2004 | Hirakawa et al. | |
| 2004/0212568 | A1 | 10/2004 | Yamada | |

FOREIGN PATENT DOCUMENTS

| | | |
|---|---|---|
| EP | 0 811 963 | 12/1997 |
| EP | 1 174 850 | 2/2000 |

(Continued)

OTHER PUBLICATIONS

Office Action mailed Nov. 26, 2007 in U.S. Appl. No. 10/968,930.
Korean Office Action dated Apr. 28, 2006 of Application No. 10-2004-0094680.

(Continued)

*Primary Examiner* — Duc Dinh
(74) *Attorney, Agent, or Firm* — Staas & Halsey LLP

(57) ABSTRACT

A driving method for a plasma display apparatus having address electrodes, scan electrodes and common electrodes and displaying one field of image by using subfields is provided. The driving method includes one specific subfield is arranged to be turned ON early in the one field and always turned ON at luminance level higher than input luminance level "0", and the specific subfield has a least luminance weight and does not have resetting.

9 Claims, 17 Drawing Sheets

FOREIGN PATENT DOCUMENTS

| | | | | |
|---|---|---|---|---|
| EP | 1085495 | | * | 3/2001 |
| EP | 1 199 701 | | | 4/2002 |
| EP | 1418566 | A1 | * | 6/2002 |
| EP | 1 418 563 | | | 5/2004 |
| EP | 1085495 | | | 10/2004 |
| JP | 11-65517 | | | 3/1999 |
| JP | 2001-92409 | | | 4/2001 |
| JP | 2002-61500 | | | 7/2002 |
| JP | 2003-66897 | | | 3/2003 |
| TW | 533397 | B | | 5/2003 |
| TW | 546622 | B | | 8/2003 |
| WO | WO 02/101704 | | | 12/2002 |

OTHER PUBLICATIONS

Taiwanese Office Action mailed Oct. 9, 2007 and issued in corresponding Taiwanese Patent No. 533397 and 546622.

European Office Action mailed Dec. 7, 2006 in correspondence to European Patent Application No. 04 256 589.5-1228.

Office Action mailed Apr. 14, 2009 in U.S. Appl. No. 10/968,930.

Office Action mailed Jun. 24, 2008 in U.S. Appl. No. 10/968,930.

Office Action mailed Dec. 29, 2008 in U.S. Appl. No. 10/968,930.

Notice of Allowance mailed Dec. 17, 2009 in U.S. Appl. No. 10/968,930.

* cited by examiner

RELATED ART

RELATED ART

RELATED ART

Fig.5

| INPUT LUMINANCE LEVEL | SF1 (1) | SF2 (2) | SF3 (4) | SF4 (8) | SF5 (16) | SF6 (32) | SF7 (64) | SF8 (128) | OUTPUT LUMINANCE LEVEL |
|---|---|---|---|---|---|---|---|---|---|
| 0 | | | | | | | | | 0 |
| 1 | ● | | | | | | | | 1 |
| 2 | | ● | | | | | | | 2 |
| 3 | ● | ● | | | | | | | 3 |
| 4 | | | ● | | | | | | 4 |
| 5 | ● | | ● | | | | | | 5 |
| 6 | | ● | ● | | | | | | 6 |
| | | | | | | | | | |
| 254 | | ● | ● | ● | ● | ● | ● | ● | 254 |
| 255 | ● | ● | ● | ● | ● | ● | ● | ● | 255 |

RELATED ART

RELATED ART

RELATED ART

Fig.10

| INPUT LUMINANCE LEVEL | SFex (0.5) | SF1 (1) | SF2 (2) | SF3 (4) | SF4 (8) | SF5 (16) | SF6 (32) | SF7 (64) | SF8 (128) | OUTPUT LUMINANCE LEVEL |
|---|---|---|---|---|---|---|---|---|---|---|
| 0 | | | | | | | | | | 0 |
| 1 | ● | | | | | | | | | 0.5 |
| 2 | ● | ● | | | | | | | | 1.5 |
| 3 | ● | | ● | | | | | | | 2.5 |
| 4 | ● | ● | ● | | | | | | | 3.5 |
| 5 | ● | | | ● | | | | | | 4.5 |
| 6 | ● | ● | | ● | | | | | | 5.5 |
| | | | | | | | | | | |
| | | | | | | | | | | |
| 254 | ● | ● | | ● | ● | ● | ● | ● | ● | 253.5 |
| 255 | ● | | ● | ● | ● | ● | ● | ● | ● | 254.5 |

Fig.18

| INPUT LUMINANCE LEVEL | SFex2 (0.25) | SFex1 (0.5) | SF1 (1) | SF2 (2) | SF3 (4) | SF4 (8) | SF5 (16) | SF6 (32) | SF7 (64) | SF8 (128) | OUTPUT LUMINANCE LEVEL |
|---|---|---|---|---|---|---|---|---|---|---|---|
| 0 | | | | | | | | | | | 0 |
| 1 | ● | | | | | | | | | | 0.25 |
| 2 | ● | ● | | | | | | | | | 0.75 |
| 3 | ● | ● | ● | | | | | | | | 1.75 |
| 4 | ● | ● | | ● | | | | | | | 2.75 |
| 5 | ● | ● | ● | ● | | | | | | | 3.75 |
| 6 | ● | ● | | | ● | | | | | | 4.75 |
| 7 | ● | ● | ● | | ● | | | | | | 5.75 |
| | | | | | | | | | | | |
| | | | | | | | | | | | |
| 254 | ● | ● | | | ● | ● | ● | ● | ● | ● | 252.75 |
| 255 | ● | ● | ● | | ● | ● | ● | ● | ● | ● | 253.75 |

DISPLAY APPARATUS AND DISPLAY DRIVING METHOD FOR ENHANCING GRAYSCALE DISPLAY CAPABLE OF LOW LUMINANCE PORTION WITHOUT INCREASING DRIVING TIME

CROSS-REFERENCE TO RELATED APPLICATION(S)

This application is related to and is a continuation of U.S. Ser. No. 10/968,930 filed on Oct. 21, 2004 now U.S. Pat. No. 7,710,359 and claims priority to application entitled prior Japanese Patent Application No. 2004-007033, filed on Jan. 14, 2004, and incorporated by reference herein.

BACKGROUND

1. Field

The embodiments discussed herein are directed to a display apparatus and a display driving method, and more particularly to a display apparatus and a display driving method suitable for driving a plasma display panel (PDP).

2. Description of the Related Art

In recent years, surface-discharge AC plasma display apparatuses have been commercially implemented as flat panel display apparatuses, and have come into wide use in such applications as display apparatuses for personal computers, workstations, and the like, as hang-on-the-wall televisions, or as apparatuses for displaying advertisements, information, etc.

The surface-discharge plasma display apparatus has a structure such that a pair of electrodes are formed on the inside surface of a front glass substrate and a rare gas is filled therein, in this structure, when a voltage is applied between the electrodes, a surface discharge occurs at the surface of a protective layer and dielectric layer formed on the electrode surface, resulting in the emission of ultraviolet light. The inside surface of a rear glass substrate is coated with phosphors of three primary colors, red (R), green (G), and blue (B), which when excited by the ultraviolet light, produce visible light to achieve a color display.

In the prior art, there is proposed a display apparatus that is designed to enhance the luminance grayscale resolution by converting input video data into output display data having a smaller grayscale step than the grayscale step of the input video data (for example, refer to Japanese Unexamined Patent Publication (Kokai) No. 2001-092409: which corresponds to EP-1085498-A2). More specifically, in plasma display apparatus proposed in the prior art, a fractional luminance subfield whose luminance level weight is smaller than "1" (that is, whose luminance level weight is "0.5") is additionally provided, and the luminance grayscale resolution is increased by using this fractional luminance subfield, without changing the number of grayscale levels normally used to represent the input video data.

SUMMARY

It is an aspect of the embodiments discussed herein to provide a display apparatus driving method for a field time division type display apparatus which displays grayscale by combining a plurality of subfields into which one field has been divided, each subfield including a resetting, an addressing, and a sustaining, wherein at least one extra subfield is additionally provided which does not have a resetting, and which stays always ON with a luminance level higher than a prescribed input luminance level.

Further, according to an aspect of the embodiments discussed herein, a display apparatus is provided including a display panel, a driver driving the display panel, and a control circuit receiving an image signal and converting the image signal into image data suitable for displaying on the display panel, wherein the control circuit controls the driver to drive the display panel by employing a display apparatus driving method for a field time division type display apparatus which displays grayscale by combining a plurality of subfields into which one field has been divided, each subfield including a resetting, an addressing, and a sustaining, wherein at least one extra subfield is additionally provided which does not have a resetting, and which stays always ON with a luminance level higher than a prescribed input luminance level.

The luminance of the extra subfield may be lower than the luminance of a subfield that has a luminance weight "1" An addressing in the extra subfield may perform an address discharge by selecting all addresses.

The prescribed input luminance level may be an input luminance level "0". The extra subfield may be set as the first subfield to be turned ON in the field. A plurality of the extra subfields may be provided, and the plurality of extra subfields may be respectively arranged as the first and second subfields to be turned ON in the field. The extra subfield may include a preprocessing which is placed before an addressing in the extra subfield.

The number of the extra subfields may be one, and the subfields other than the one extra subfield may be turned ON by increasing the luminance level by one level with respect to an input luminance level. The one extra subfield may be a subfield whose luminance weight is "0.5". Grayscale higher than an input luminance level "1" may be displayed by combining the subfields other than the one extra subfield.

The number of the extra subfields may be two, and the subfields other than the two extra subfields may be turned ON by increasing the luminance level by two levels with respect to an input luminance level. The two extra subfields may be subfields whose luminance weights are "0.25" and "0.5", respectively. Grayscale higher than a luminance level "2" may be displayed by combining the subfields other than the two extra subfields.

The extra subfield may have no sustaining. The display apparatus may be a plasma display apparatus.

It is an aspect of an embodiment described herein to provide a driving method for a plasma display apparatus having address electrodes, scan electrodes and common electrodes and displaying one field of image by using subfields that includes one specific subfield arranged to be turned ON early in the one field and always turned ON at luminance level higher than input luminance level "0", and the specific subfield has a least luminance weight and does not have resetting.

It is an aspect of an embodiment described hereinto provide a driving method for a plasma display apparatus having address electrodes, scan electrodes and common electrodes and displaying one field of image by using a plurality of subfields, wherein one specific subfield is arranged to be turned ON early in the one field and always turned ON at luminance level higher than input luminance level "0", the specific subfield has a least luminance weight and does not have a resetting, and a preprocessing placed before an addressing is provided and a waveform having a voltage value lowering with time is applied in the preprocessing.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 5 is a diagram showing the relationship between subfield combination and output luminance level according to the grayscale driving sequence of FIG. 4;

FIG. 10 is a diagram showing the relationship between subfield combination and output luminance level according to the grayscale driving sequence of FIG. 9;

FIG. 18 is a diagram showing the relationship between subfield combination and output luminance level according to the grayscale driving sequence of FIG. 17.

DETAILED DESCRIPTION OF THE EMBODIMENTS

Before proceeding to the detailed description of the preferred embodiments of the present invention, the prior art display apparatuses and display driving methods and their associated problems will be described with reference to FIGS. 1 to 7.

Figure 1:
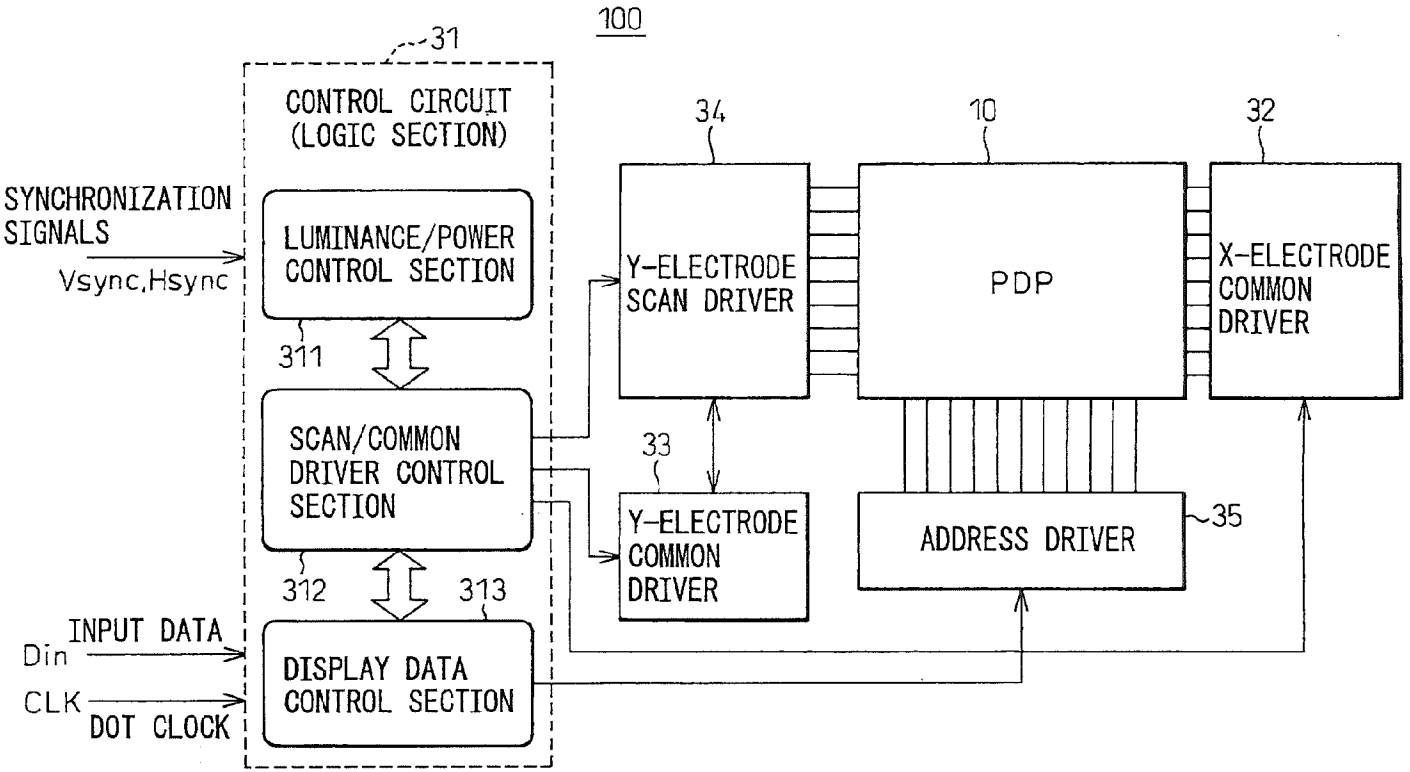
FIG. 1 is a block diagram schematically showing the general configuration of one example of a plasma display apparatus.

FIG. 1 is a block diagram schematically showing the general configuration of a plasma display apparatus as one example of the display apparatus, the plasma display apparatus shown here uses a currently commercialized conventional three-electrode surface-discharge AC-driven type plasma display panel (PDP). The plasma display apparatus shown in FIG. 1 is only one example, and it will be recognized that the present invention described herein can be applied not only to the plasma display apparatus shown in FIG. 1 but also to display apparatuses of various other configurations.

The plasma display apparatus 100 includes a PDP 10, an X-electrode common driver 32, a Y-electrode common driver 33, a Y-electrode scan driver 34, and an address driver 35 for driving the cells of the PDP 10, and a control circuit (logic section) 31 for controlling these drivers. The control circuit 31 receives input data Din, i.e., multivalued image data representing the luminance levels (input luminance levels) of three colors of R, G, and B, a dot clock CLK, and various synchronization signals (horizontal synchronization signal Hsync, vertical synchronization signal Vsync, etc.) from an external apparatus such as a TV tuner or a computer, and supplies suitable control signals to the respective drivers 32 to 35 based on the input data Din, dot clock CLK, and various synchronization signals, to display a prescribed image.

The control circuit 31 comprises: a luminance/power control section 311 which controls the luminance and the power consumption of the PDP 10, a scan/common driver control section 312 which controls the scanning of Y electrodes via the Y-electrode scan driver 34 and also controls sustain discharges produced between X electrodes and Y electrodes via the X-electrode common driver 32, Y-electrode common driver 33, etc., and a display data control section 313 which controls the data to be displayed on the PDP 10 via the address driver 35.

Figure 2:
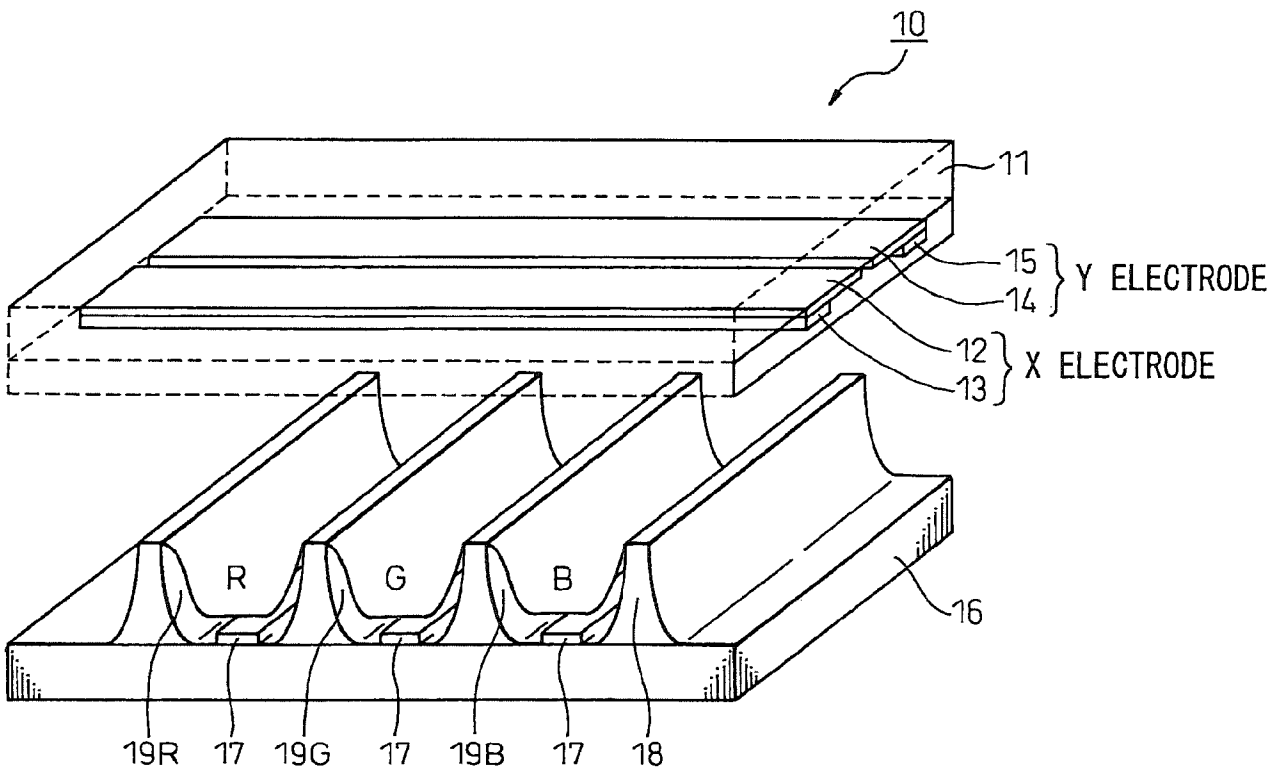
FIG. 2 is a diagram schematically showing one example of a plasma display panel used in the plasma display apparatus shown in FIG. 1.

FIG. 2 is a diagram schematically showing one example of the plasma display panel (PDP 10) used in the plasma display apparatus shown in FIG. 1, a three-electrode surface-discharge AC plasma display panel is shown here.

In FIG. 2, reference numeral 10 is the plasma display panel (PDP), 11 is a front substrate, 12 is a transparent electrode for an X electrode, 13 is a bus electrode for the X electrode, 14 is a transparent electrode for a Y electrode, 15 is a bus electrode for the Y electrode, 16 is a rear substrate, 17 is an address electrode, 18 is a barrier (rib), and 19R, 19G, and 19B are phosphor layers of red (R), green (G), and blue (B), respectively. In the actual PDP 10, a dielectric layer and a protective layer are formed on the X and Y electrodes, and each address electrode is covered with a dielectric layer.

Further, the gap between the front substrate 11, on which the X electrode (12, 13) and Y electrode (14, 15) are formed, and the rear substrate 16, on which the address electrode 17 is formed, is filled with a discharge gas such as a neon/xenon mixture gas, and a discharge space where the X and Y electrodes intersect with each address electrode forms one discharge cell.

Figure 3:
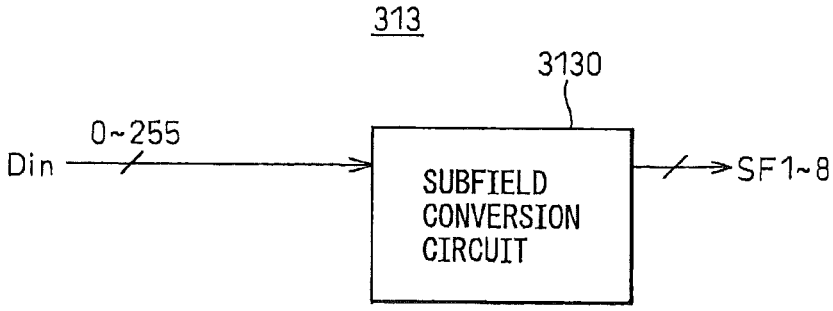
FIG. 3 is a block diagram schematically showing the configuration of a portion as one example of a display data control section of a control circuit in a prior art plasma display apparatus.
Figure 4:
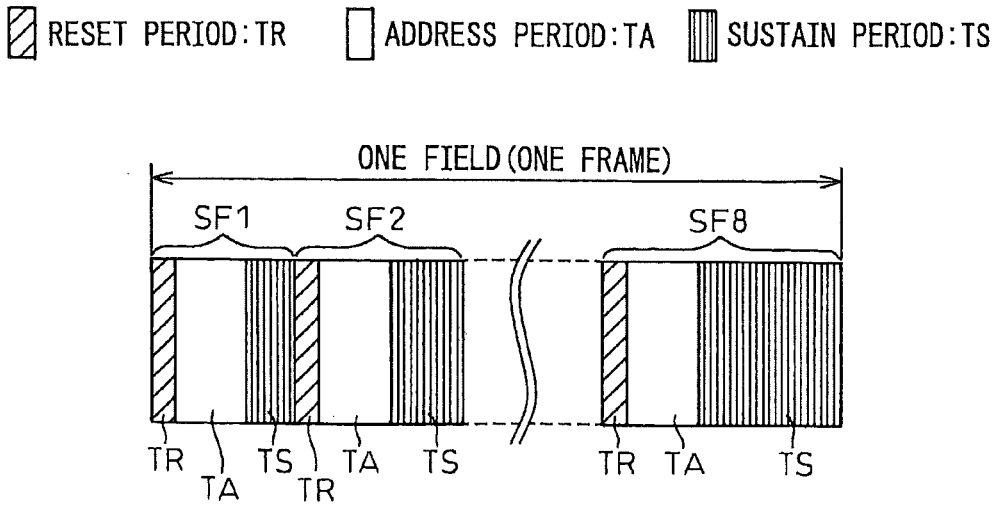
RELATED ART Fig. 4
FIG. 4 is a diagram showing one example of a grayscale driving sequence according to the prior art.

FIG. 3 is a block diagram schematically showing the configuration of a portion as one example of the display data control section 313 of the control circuit 31 in the prior art plasma display apparatus 100, and FIG. 4 is a diagram showing one example of a grayscale driving sequence according to the prior art.

The display data control section 313 comprises a subfield conversion circuit 3130 which converts the input data Din representing, for example, 256 grayscale levels (input luminance levels of 0 to 255) for each of the R, G, and B colors, into a plurality of (for example, eight) subfields SF1 to SF8 as shown in FIG. 4, and the PDP 10 is driven based on the subfields SF1 to SF8.

More specifically, as shown in FIG. 4, according to the prior art grayscale driving sequence for the plasma display apparatus, one field (frame) is divided into a plurality of (for example, eight) subfields (subframes) SF1 to SF8, each having a prescribed luminance weight, and a desired grayscale level is displayed by combining these subfields. Here, the eight subfields SF1 to SF8 are each assigned a luminance weight expressed, for example, as a power of 2, and the ratio of the number of sustain discharges among the subfields SF1 to SF8 is set as 1:2:4:8:16:32:64:128, to produce a display with 256 grayscale levels (output luminance levels of 0 to 255).

Each of the subfields (SF1 to SF8) comprises a reset period (initialization process: a period during which a resetting step is performed) TR in which wall charges are made uniform over all cells in the display area, an address period (addressing process: a period during which an addressing step is performed) TA in which a cell to be turned ON is selected, and a sustain period (sustain discharge period: display process: a period during which a sustaining step is performed) TS in which the selected cell is discharged (for light emission) the number of times that matches its luminance level, that is, in each subfield, the cell is turned ON in accordance with its luminance level, and one field of image display is accomplished by displaying, for example, eight subfields (SF1 to SF8).

FIG. 5 is a diagram showing the relationship between subfield combination and output luminance level according to the grayscale driving sequence of FIG. 4.

As shown in FIG. 5, when the input (output) luminance level increases successively from level 0 toward level 255, the subfield SF1 whose luminance weight is "1" turns ON and OFF alternately as the input luminance level increases, and the subfield SF2 whose luminance weight is "2" turns ON and OFF every two levels as the input luminance level increases, similarly, the subfield SF3 whose luminance weight is "4" turns ON and OFF every four levels as the input luminance level increases, and the subfield SF4 whose luminance weight is "8" turns ON and OFF every eight levels as the input luminance level increases.

Accordingly, depending on the combination of subfields used to represent grayscale, since an electric discharge does not occur for a certain duration of time, the time required for an address discharge (address period TA) and the time required for a sustain discharge (sustain period TS) become longer in the next subfield. This is because, in a PDP cell, if the elapsed time from the immediately preceding discharge becomes long, the discharge path within the cell disappears, making the next discharge difficult to occur or requiring a longer time to form a sufficient wall charge by the address discharge.

Figure 6:
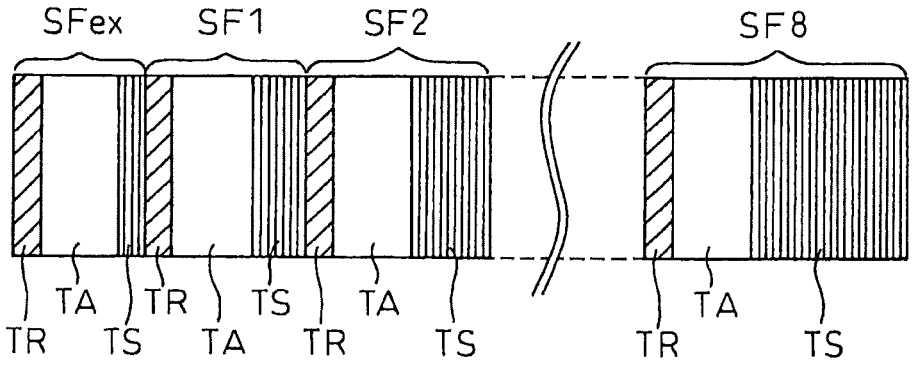
FIG. 6 is a diagram showing one example of a grayscale driving sequence according to the related art.

FIG. 6 is a diagram showing one example of a grayscale driving sequence according to the related art, in this example, an extra subfield SFex whose luminance weight is "0.5" is simply added in order to enhance the grayscale display capability.

Figure 7:
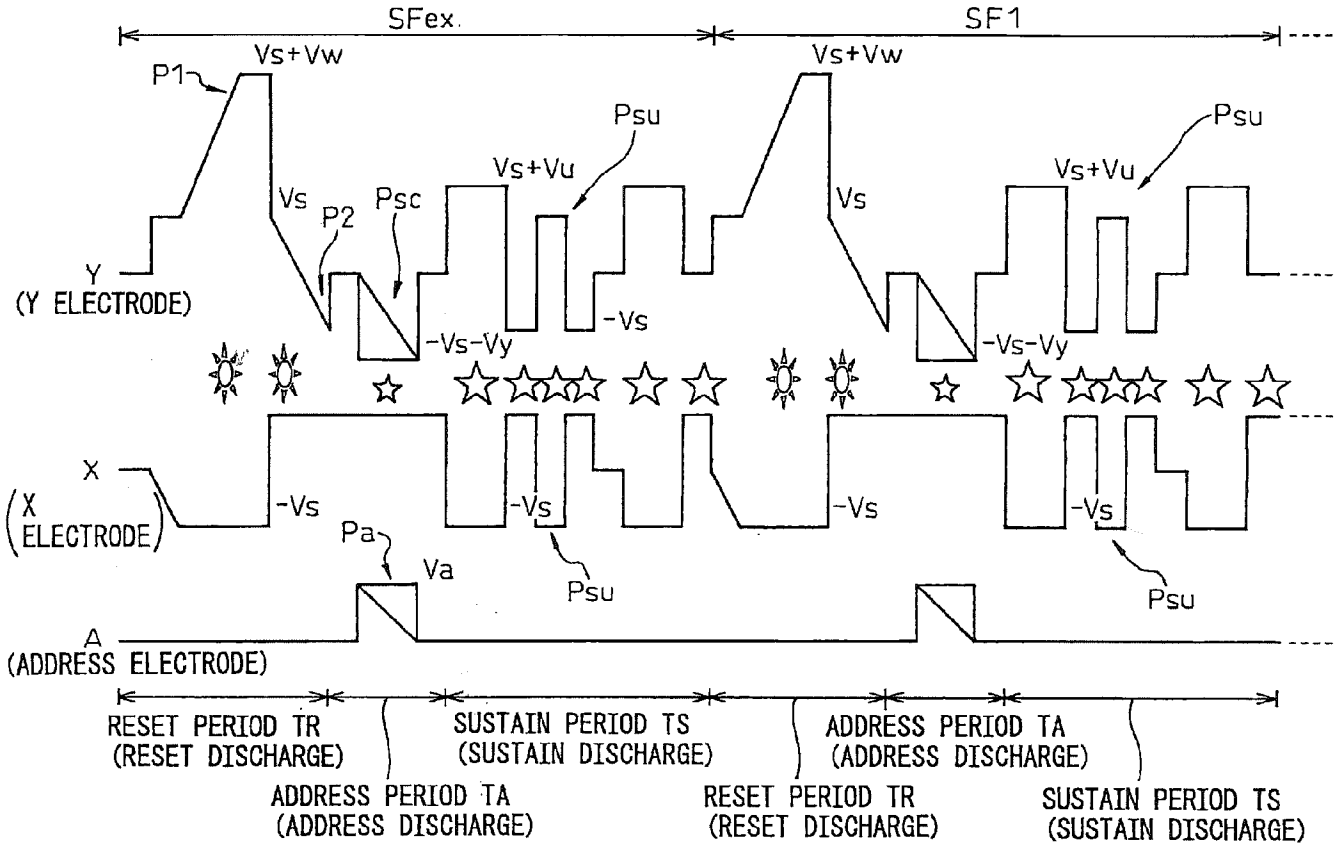
FIG. 7 is a diagram showing one example of a driving waveform in the grayscale driving sequence of FIG. 6.

FIG. 7 is a diagram showing one example of a driving waveform in the grayscale driving sequence of FIG. 6 for the extra subfield SFex whose luminance weight is "0.5" and the subfield SF1 whose luminance weight is "1".

As shown in FIGS. 6 and 7, the extra subfield SFex, like the regular subfields SF1 to SF8, comprises a reset period (the period during which the resetting step is performed) TR, an address period (the period during which the addressing step is performed) TA, and a sustain period (the period during which the sustaining step is performed) TS.

First, in the reset period TR of the extra subfield SFex, a wall charge is written to the cell by a pulse P1, and a wall voltage is adjusted while erasing the wall charge by a pulse P2. In the address period TA that follows, a sequential scan pulse Psc is applied to the Y electrode (Y: 14, 15) and, at the same time, an address pulse Pa is applied to the address electrode (A: 17) in the cell to be turned ON in accordance with the display data, thus producing an address discharge and accumulating a wall charge.

In the sustain period Ts that follows, a sustain pulse Psu is applied to the X electrode (X: 12, 13) and the Y electrode, thus turning ON only the cell in which the wall charge has been accumulated by the address discharge. The luminance of the cell is controlled by controlling the number of sustain discharge pulses.

As is apparent from FIGS. 6 and 7, the driving waveform in the extra subfield SFex is substantially the same as that in the subfield SF1. However, though not shown in FIG. 7, the extra subfield SFex differs from the subfield SF1 in the number of sustain pulses Psu (sustain discharges) applied in the sustain period TS, for example, when the luminance weight of the extra subfield SFex is "0.5" and the luminance weight of the subfield SF1 is "1", the number of sustain pulses Psu in the extra subfield SFex is chosen to be about one half of that in the subfield SF1. The driving waveform is substantially the same for the other subfields SF2 to SF8, and the number of sustain pulses Psu is chosen to match the luminance weight of each individual subfield.

Traditionally, plasma display apparatuses, for example, have had the problem that if the number of reproducible grayscale levels is small, grainy noise due to error diffusion becomes noticeable, degrading the image quality of a low luminance portion. The method generally employed to solve this problem is to increase the number of reproducible grayscale levels by increasing the number of subfields as described with reference to FIGS. 6 and 7, but in the case of PDPs that reproduce grayscale by combining the subfields (luminance ratio), there is a limit to the number of grayscale levels that can be reproduced, because the number of subfields that can be accommodated within one field is limited due to time constraints.

Further, when the number of subfields is increased by adding the extra subfield SFex, the number of resets increases correspondingly, so that the brightness of the background increases and the contrast decreases, which is undesirable.

Another method to increase the number of reproducible grayscale levels is by increasing the luminance ratio, but with this method, since image artifacts such as false contouring occur when displaying a moving image, there is a limit to the combination of subfields (luminance ratio).

It is an aspect of embodiments discussed herein to provide a display apparatus and a driving method for the same in which provisions are made to enhance the grayscale display capability for a low luminance portion while suppressing an increase in the time required for driving, and further provisions are made to prevent an address discharge from becoming difficult to occur in a cell, by not allowing a long time to elapse from the immediately preceding discharge produced in the cell.

Figure 8:
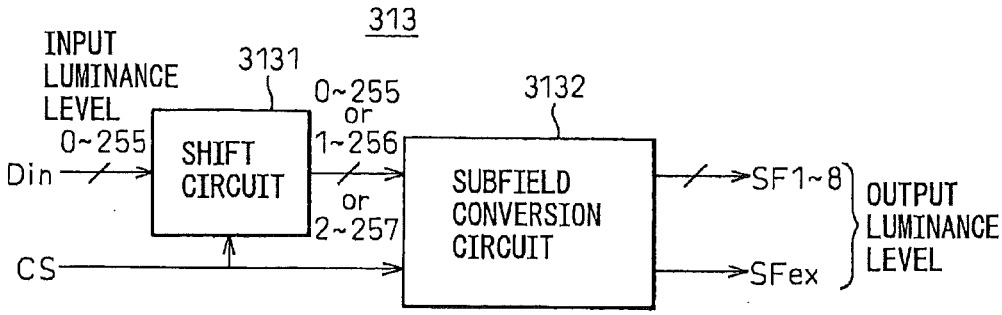
FIG. 8 is a block diagram schematically showing the configuration of a portion as one example of the display data control section of the control circuit in a display apparatus according to the present invention.
Figure 9:
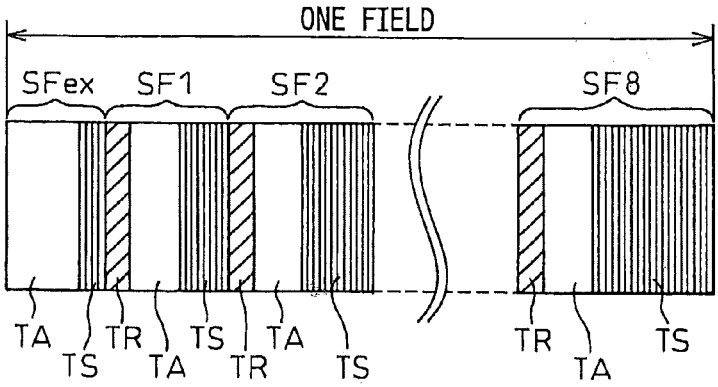
FIG. 9 illustrates an exemplary grayscale driving sequence according to a first embodiment of the display apparatus driving method of the present invention.

FIG. 8 illustrates an exemplary configuration of a portion as one example of the display data control section of the control circuit in the display apparatus according to the present invention, and FIG. 9 illustrates an exemplary grayscale driving sequence according to a first embodiment of the display apparatus driving method of the present invention.

As shown in FIG. 8, one example of the display data control section 313 of the control circuit 31 in the display apparatus of the present invention comprises a shift circuit 3131 and a subfield conversion circuit 3132.

The shift circuit 3131 shifts the input data Din representing, for example, 256 grayscale levels (input luminance levels of 0 to 255) for each of the R, G, and B colors in accordance with a control signal CS supplied from the scan/common driver control section 312, and outputs data with luminance levels 0 to 255 (no shifts), 1 to 256 (shifted by 1), or 2 to 257 (shifted by 2). The subfield conversion circuit 3132 receives the output of the shift circuit 3131 and the control signal CS, and converts the data into subfields SF1 to SF8 and an extra subfield SFex for output, as shown, for example, in FIG. 9, and the PDP 10 is driven based on these subfields SF1 to SF8 and the extra subfield SFex.

Figure 17:
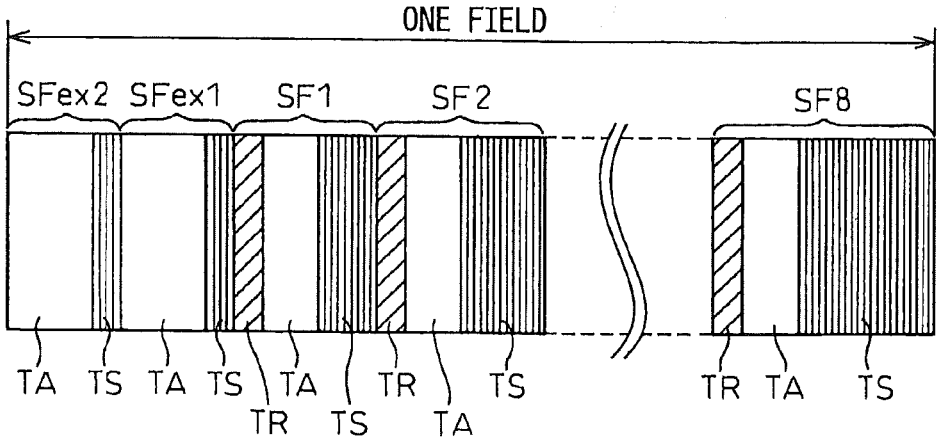
FIG. 17 illustrates an exemplary grayscale driving sequence according to a fourth embodiment of the display apparatus driving method of the present invention.

Here, the case where the output of the shift circuit 3131 represents the luminance levels 1 to 256 (actually, up to 255) corresponds, for example, to the case where the extra subfield SFex such as shown in FIGS. 9 and 10 is used, and the case where the output of the shift circuit 3131 represents the luminance levels 2 to 257 (actually, up to 255) corresponds, for example, to the case where extra subfields SFex1 and SFex2 such as shown in FIGS. 17 and 18 are used. The subfield conversion circuit 3132 is configured to handle the output of the shift circuit 3131 up to the luminance level 255, and therefore, does not output any subfield combination when the output of the shift circuit 3131 corresponds to the luminance level 256 or 257.

More specifically, as shown in FIG. 9, in the grayscale driving sequence according to a first embodiment of the driving method of the present invention for the display apparatus (for example, a plasma display apparatus), one field is divided into a plurality of (for example, nine) subfields, i.e., the extra subfield SFex and the subfields SF1 to SF8, each having a prescribed luminance weight, and a desired grayscale level is displayed by combining these subfields. As in the prior art, the eight subfields SF1 to SF8 are each assigned a luminance weight expressed, for example, as a power of 2, and the ratio of the number of sustain discharges among the subfields SF1 to SF8 is set as 1:2:4:8:16:32:64:128, to produce a display with 256 grayscale levels. On the other hand, the extra subfield SFex has a luminance weight of, for example, "0.5", which is one half of that of the subfield SF1 in which the number of sustain discharges is defined by the luminance weight "1".

As in the prior art, each of the subfields SF1 to SF8 comprises a reset period TR in which wall charges are made uniform over all cells in the display area, an address period TA in which a cell to be turned ON is selected, and a sustain period TS in which the selected cell is discharged the number of times that matches its luminance level. On the other hand, the extra subfield SFex comprises an address period TA and a sustain period TS. Then, in each subfield, the cell is turned ON in accordance with its luminance level, and one field of display is accomplished by displaying, for example, nine subfields (SFex and SF1 to SF8).

FIG. 10 is a diagram showing the relationship between subfield combination and output luminance level according to the grayscale driving sequence of FIG. 9.

As shown in FIG. 10, the extra subfield SFex is always ON, except when the input (output) luminance level is level 0. As for the other eight subfields SF1 to SF8, as the input luminance levels of 0 to 255 are shifted to the levels of 1 to 256 by the shift circuit 3131, the output luminance level defined by the combination of the extra subfield SFex and subfields SF1 to SF8 changes from 0 to 0.5, to 1.5, to 2.5, . . . , to 254.5 as the input luminance level successively increases from 0 to 1, to 2, to 3, to 255. Since this is equivalent to increasing the number of grayscale levels by 1 for the low luminance portion, the grayscale display capability is equivalently doubled. Otherwise, the grayscale display capability is substantially the same as that achieved in the prior art since the luminance step is the same, though the output luminance level is reduced by 0.5.

Figure 11:
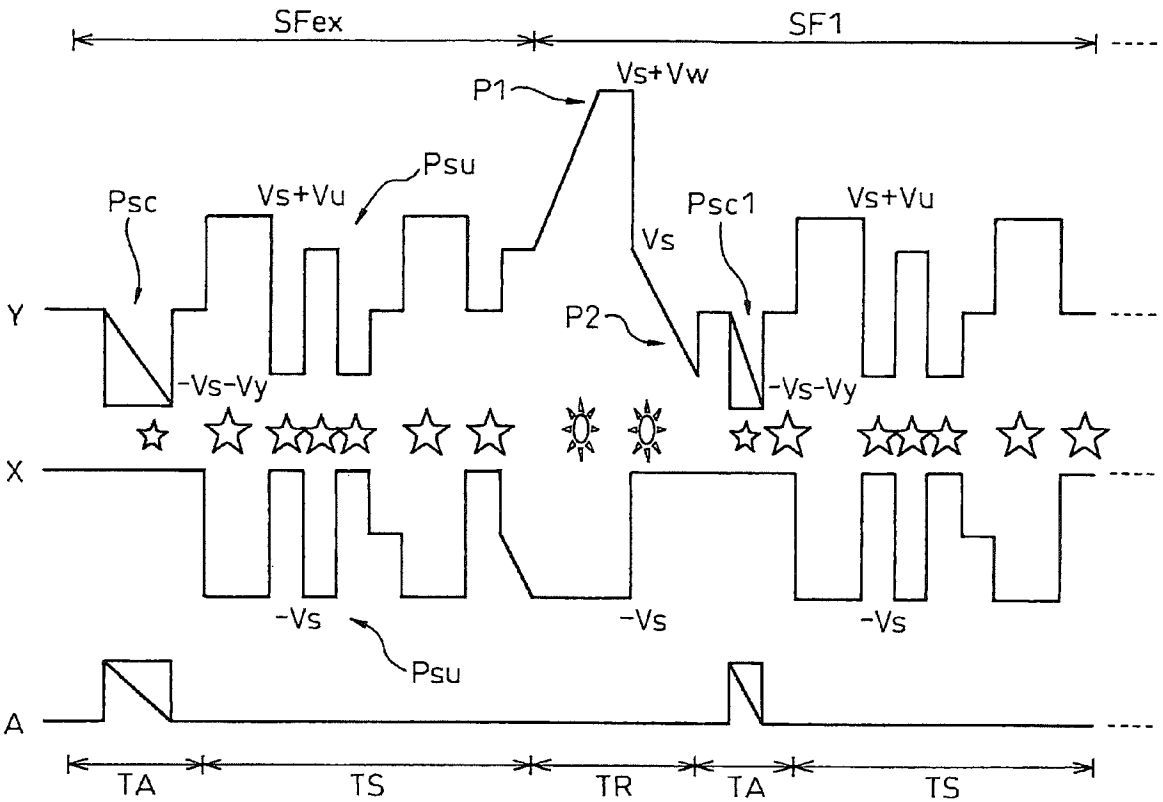
FIG. 11 illustrates an exemplary driving waveform in the grayscale driving sequence of FIG. 9.

FIG. 11 illustrates an exemplary driving waveform in the grayscale driving sequence of FIG. 9 for the extra subfield SFex whose luminance weight is "0.5" and the subfield SF1 whose luminance weight is "1".

As shown in FIGS. 9 and 11, the extra subfield SFex is set as the first subfield to be turned ON in the one filed. Here, the reset period TR as included in the regular subfields SF1 to SF8 is eliminated from the extra subfield SFex which thus comprises only the address period TA and the sustain period TS.

In the address period TA of the extra subfield SFex, a sequential scan pulse Psc is applied to the Y electrode (Y: 14, 15) and, at the same time, an address pulse Pa is applied to the address electrode (A: 17) in the cell to be turned ON in accordance with the display data, causing an address discharge and thus accumulating a wall charge. Here, in the address period TA of the extra subfield SFex, the address discharge is performed by selecting all the addresses. In the sustain period Ts that follows, a sustain pulse Psu is applied to the X electrode (X: 12, 13) and the Y electrode, thus turning ON all the cells in which the wall charge has been accumulated by the address discharge.

Next, in the reset period TR of the subfield SF1, a wall charge is written to the cell by a pulse P1, and a wall voltage is adjusted while erasing the wall charge by a pulse P2. In the address period TA that follows, a sequential scan pulse Psc is applied to the Y electrode (Y) and, at the same time, an address pulse Pa is applied to the address electrode (A) in the cell to be turned ON in accordance with the display data, thus producing an address discharge and accumulating a wall charge.

Here, for example, as shown in FIG. 11, the time required to perform the address discharge in the address period TA of the subfield SF1, that is, the time required to accumulate a sufficient wall charge in the cell to be turned ON in accordance with the display data in order to be able to perform the subsequent sustain discharge correctly, can be shortened because the address discharge is performed on all the cells in the address period TA of the immediately preceding extra subfield SFex. This also holds true for the other subfields, that is, since the discharge by the extra subfield SFex is performed on all the cells at least once in one field except for the case of the input luminance level 0, there is no cell that remains undischarged for a long time, and as a result, the address period TA can be accomplished in a relatively short time.

In this way, according to the display apparatus driving method of a first embodiment, by adding the subfield (the extra subfield SFex whose luminance weight is "0.5") having a luminance lower than the lowest luminance (luminance weight "1" for the subfield SF1) in the subfield group (SF1 to SF8) usually used to represent the grayscale, the grayscale display capability for the low luminance portion can be enhanced (doubled) without increasing the brightness of the background. That is, since the extra subfield SFex is always ON, there is no need to extinguish it except when displaying full black, and since the reset period TR can be eliminated, the brightness of the background is substantially the same as when the extra subfield SFex is not added.

Here, since the added extra subfield SFex is the LSB (least significant bit) of the output luminance level, the subfields (SF1 to SF8) usually used to represent the grayscale are displayed by shifting the level by +1 (to 1-256 (255)) with respect to the input luminance level (0-255). As a result, for the input luminance levels 0 and 1 to 255, the extra subfield SFex and the subfields SF1 to SF8 combine to produce output luminance levels 0 and 0.5 to 254.5, respectively.

Further, according to the display apparatus driving method of a first embodiment, since the extra subfield SFex is always ON (except when the input luminance level is 0), the need for a reset pulse (reset period TA) necessary to write the extra subfield SFex can be eliminated, and as a result, the time required for driving can be shortened, which serves to prevent the brightness of the background from increasing. Furthermore, the inclusion of the extra subfield SFex that is always ON contributes to stabilizing the light emission state of the other subfields (SF1 to SF8), and as a result, the address period TA and the sustain period TS in each of the subfields SF1 to SF8 can be shortened, achieving a substantial reduction in the time required for driving.

Here, when producing a black display state from the state in which the subfields are on, a reset period becomes necessary in order to extinguish the ON cells, but there will be no problem because the starting subfield can be extinguished by utilizing the reset period TR of the second subfield (SF1) that immediately follows the extra subfield SFex.

However, when switching the display from the black state to an arbitrary grayscale level, if the starting subfield is to be turned ON without performing a reset, the formation of a wall charge may become unstable, making it difficult to turn ON the subfield. In view of this, in a modified example of a first embodiment hereinafter described, a preprocessing period TP is provided at the head of the extra subfield SFex.

Figure 12:
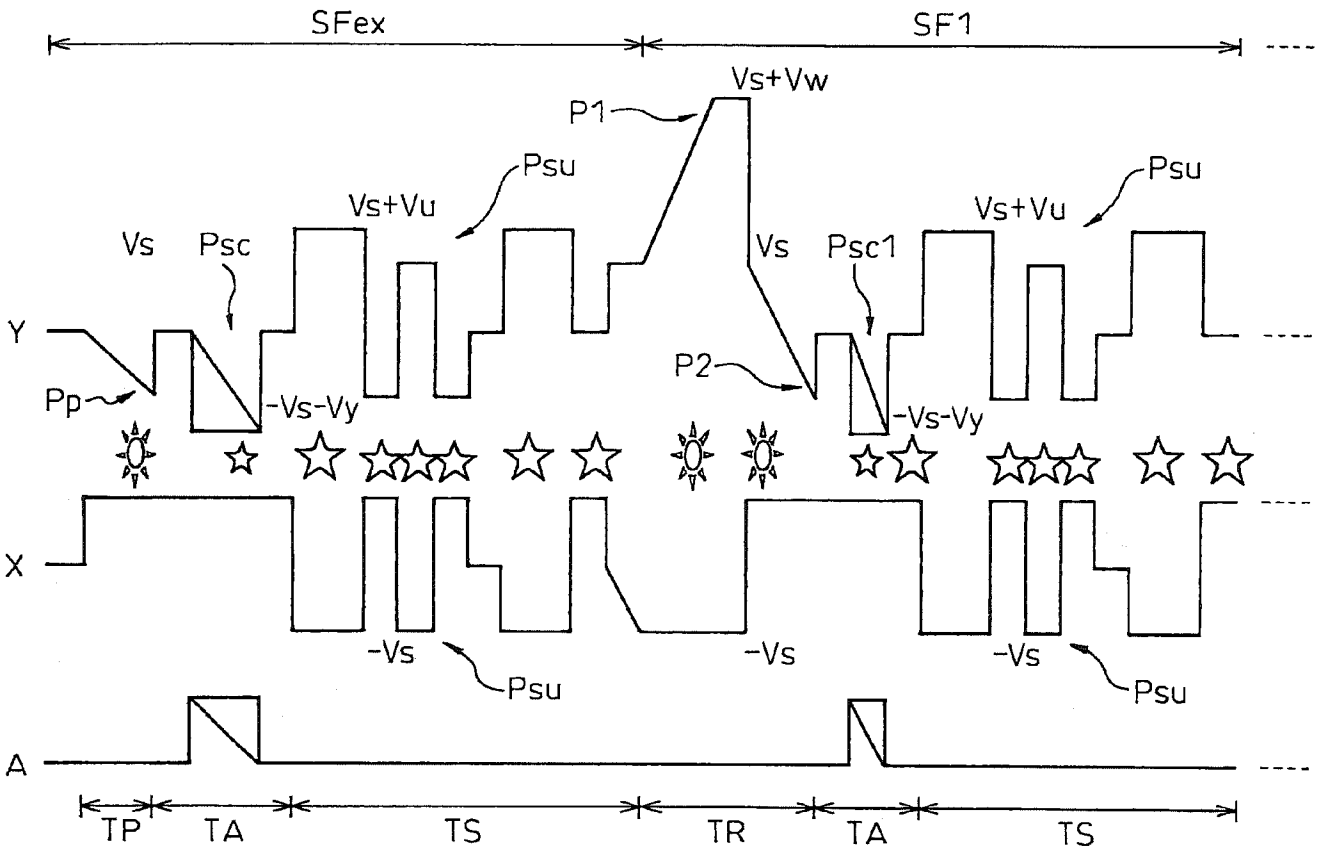
FIG. 12 is a diagram showing a modified example of the driving waveform of FIG. 11.

FIG. 12 is a diagram showing the modified example of the driving waveform of FIG. 11.

As is apparent from a comparison between FIG. 12 and FIG. 11, the extra subfield SFex begins with the preprocessing period TP in the modified example of a first embodiment. The pulse Pp applied to the Y electrode in the preprocessing period TP corresponds, for example, to the second pulse P2 applied in the reset period TR to adjust the wall voltage while erasing the wall charge, when the preprocessing period TP is provided at the beginning of each field (i.e., at the head of the extra subfield SFex), the light emission state of the extra subfield SFex whose luminance weight is "0.5" can be turned ON stably. That is, when the preprocessing period TP is provided at the head of the extra subfield SFex, as in the modified example, it becomes possible to further stabilize the light emission state of the extra subfield SFex, though the driving time increases somewhat compared with the foregoing first embodiment. It will, however, be appreciated that, even in the case of the modified example, the required driving time can be shortened compared with the related art explained with reference to FIGS. 6 and 7.

Figure 13:
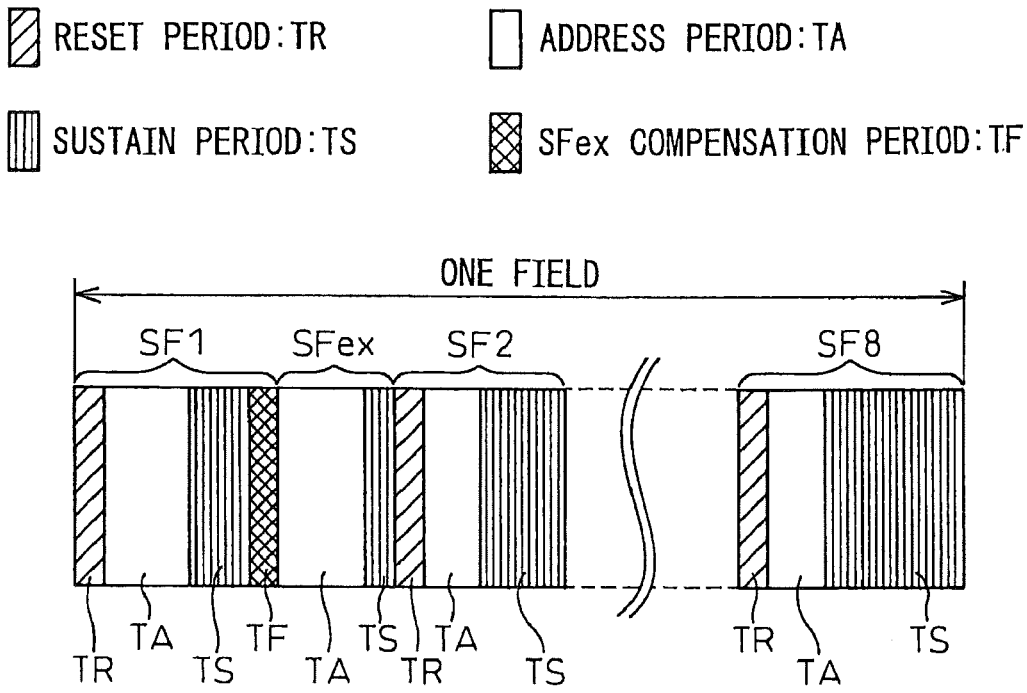
FIG. 13 illustrates an exemplary grayscale driving sequence according to a second embodiment of the display apparatus driving method of the present invention.
Figure 14:
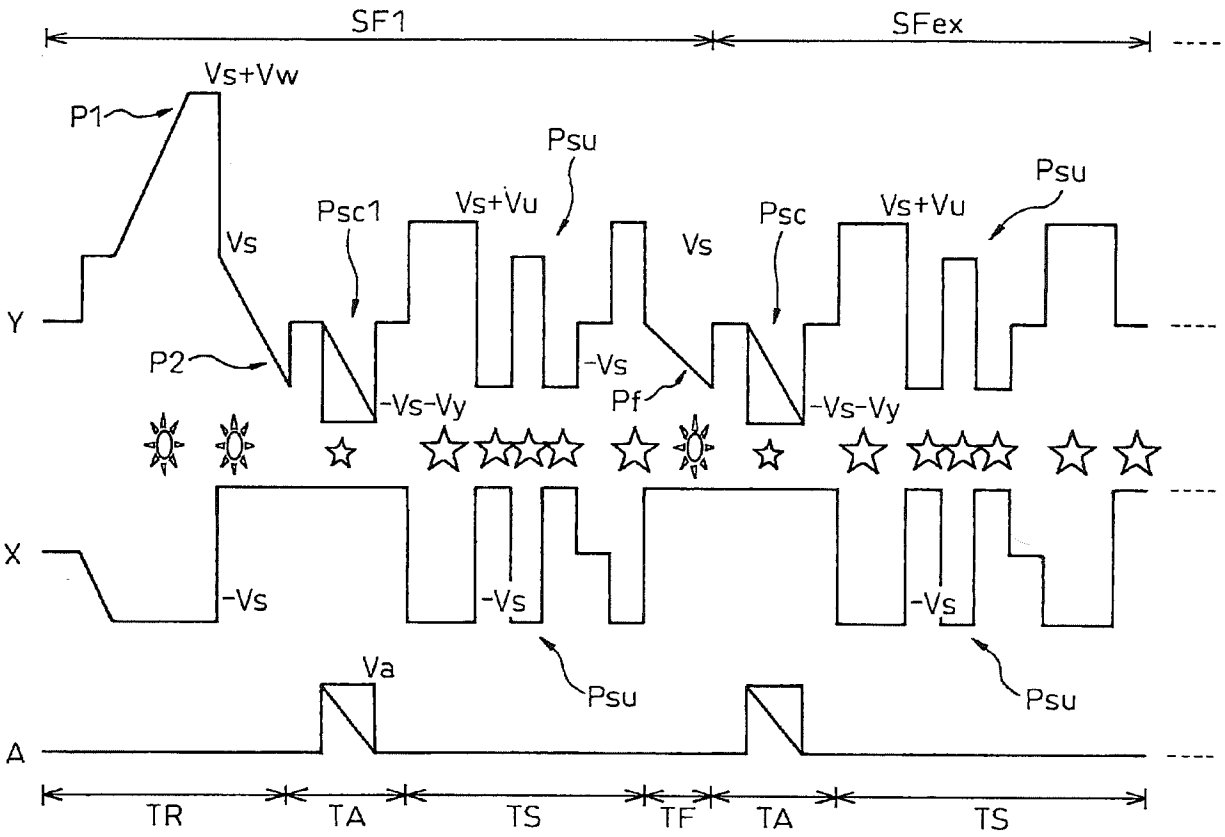
FIG. 14 illustrates an exemplary driving waveform in the grayscale driving sequence of FIG. 13.

FIG. 13 illustrates an exemplary grayscale driving sequence according to a second embodiment of the display apparatus driving method of the present invention, and FIG. 14 illustrates an exemplary driving waveform in the grayscale driving sequence of FIG. 13.

As is apparent from the comparison of FIGS. 13 and 14 with FIGS. 9 and 11, the order of the extra subfield SFex and the subfield SF1 with a luminance weight of "1" in the modified example of a first embodiment is interchanged in a second embodiment. That is, the extra subfield SFex need not be set as the first subfield to be turned ON in the one field, but may be inserted at any position within the one field. More specifically, even when the extra subfield SFex which is turned ON for all luminance levels other than the luminance level 0 is inserted at any position within the one field, the address period TA in each of the subfields that follow the extra subfield SFex can be shortened because all the cells are turned ON at least once in one field except for the case of the input luminance level 0.

In a second embodiment, a pulse Pf corresponding to the pulse Pp applied to the Y electrode in the preprocessing period TP in the modified example of a first embodiment is applied in a postprocessing period TF included at the end of the first subfield SF1 to be turned ON. Of course, a similar pulse may be applied to the Y electrode in the preprocessing period TP of the extra subfield SFex that follows the subfield SF1, or alternatively, such a pulse may be omitted.

When a postprocessing discharge is performed by applying the pulse Pf in the postprocessing period TF of the subfield SF1, then even if the reset period TR is not provided in the extra subfield SFex, the subfield can be turned ON properly even when switching the display, for example, from the black state to an arbitrary grayscale level. At this time, the preprocessing period TP in which the pulse Pp is applied has a negligible effect on the driving time as it is sufficiently shorter than the usual reset period TR.

Further, in a second embodiment, while it is not possible to shorten the address period TA (the time required to perform the address discharge by applying the sequential scan pulse Psc1, Psc to the Y electrode) in the subfield period SF1 and the extra subfield SFex, the address period TA and the sustain period TS in each of the subfields SF2 to SF8 that follow the extra subfield SFex can be shortened, achieving a reduction in the driving time.

Figure 15:
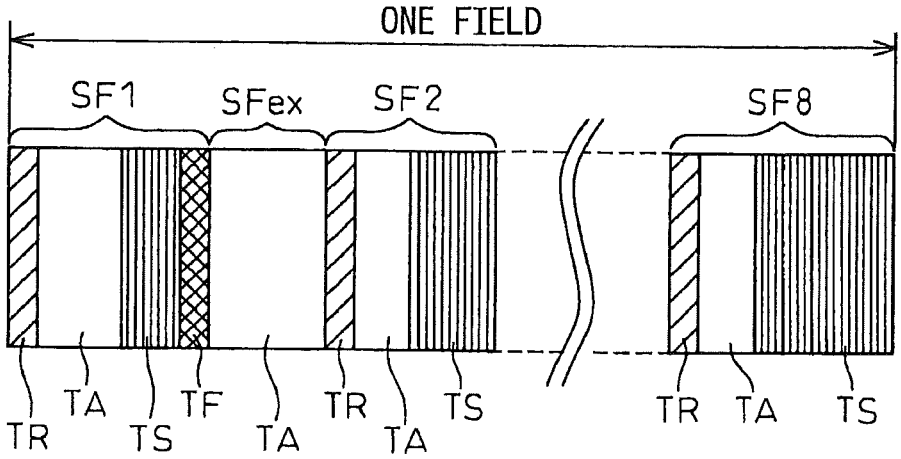
FIG. 15 illustrates an exemplary grayscale driving sequence according to a third embodiment of the display apparatus driving method of the present invention.

FIG. 15 illustrates an exemplary grayscale driving sequence according to a third embodiment of the display apparatus driving method of the present invention.

As is apparent from a comparison between FIG. 15 and FIG. 13, the sustain period TS of the extra subfield SFex in the foregoing second embodiment is omitted in the third embodiment. In this case, the extra subfield SFex does not have the luminance weight "0.5", and therefore, the grayscale display capability for the low luminance portion cannot be enhanced, but the address period in each of the other subfields SF2 (SF1) to SF8 can be shortened to achieve a reduction in the driving time.

Figure 16:
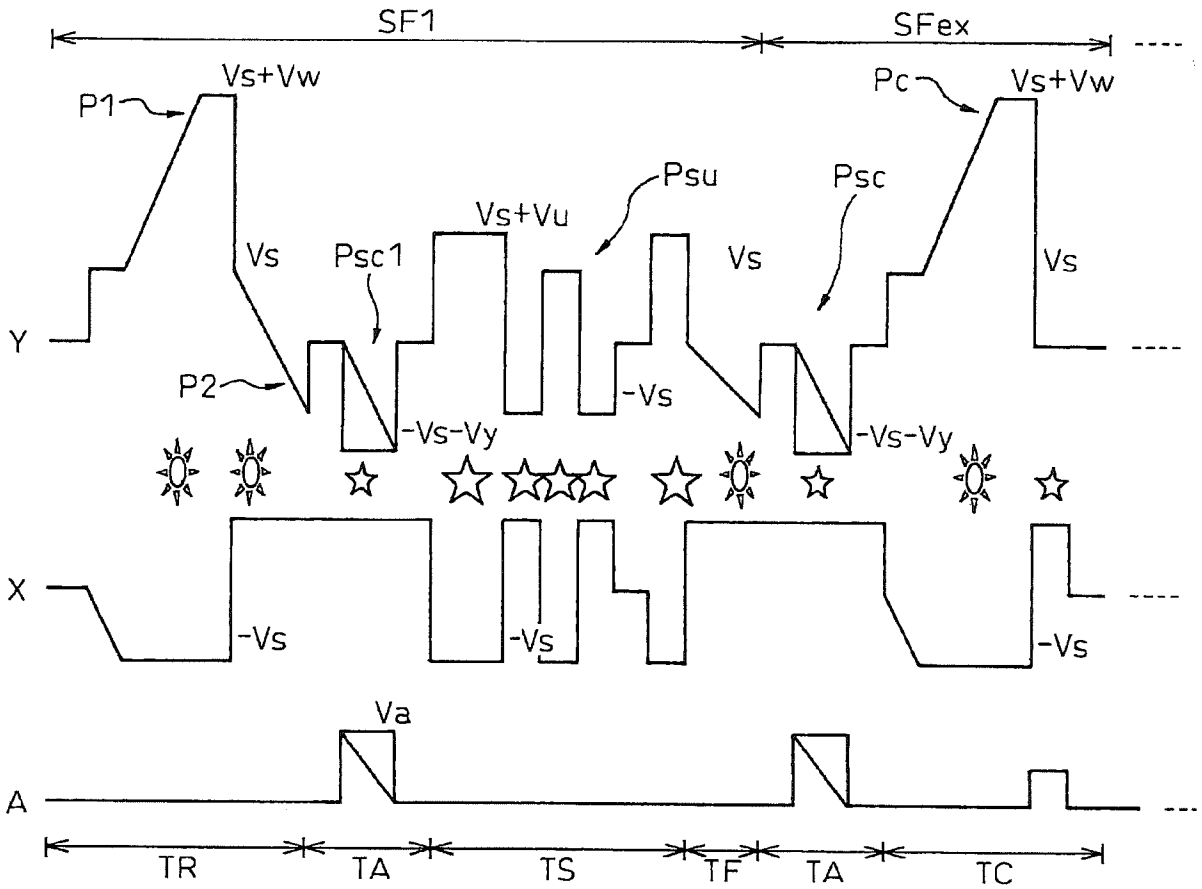
FIG. 16 illustrates an exemplary driving waveform in a modified example of the grayscale driving sequence of FIG. 15.

FIG. 16 illustrates an exemplary driving waveform in a modified example of the grayscale driving sequence of FIG. 15.

As is apparent from a comparison between FIG. 16 and FIG. 14, the sustain period TS provided in the extra subfield SFex in the foregoing second embodiment is replaced by a compensation period TC in the modified example of the third embodiment. In the compensation period TC, a pulse Pc corresponding, for example, to the first pulse P1 applied in the reset period TS to write the wall charge to the cell is applied to the Y electrode.

As described in detail above, in the present invention, the extra subfield SFex can be inserted at any subfield position, but it is preferable to insert it as the subfield to be turned ON at the beginning or at an early stage in one field, because then the address period TA in each of the subsequent subfields can be shortened and the driving time reduced. Further, as explained with reference to the above embodiments and modified examples, the extra subfield SFex and the subfield immediately preceding the extra subfield SFex can be constructed and arranged in various ways, and appropriate ones will be selected according to the structure and the driving method of the display apparatus or according to various conditions such as the time allowed to drive the display apparatus, the required image quality, etc.

FIG. 17 illustrates an exemplary grayscale driving sequence according to a fourth embodiment of the display apparatus driving method of the present invention, and FIG. 18 is a diagram showing the relationship between subfield combination and output luminance level according to the grayscale driving sequence of FIG. 17.

As shown in FIGS. 17 and 18, an extra subfield SFex1 whose luminance weight is "0.5" and an extra subfield SFex2 whose luminance weight is "0.25" are added in the fourth embodiment. The extra subfield SFex2 whose luminance weight is "0.25" is set as the first subfield to be turned ON in the one field, and the extra subfield SFex1 whose luminance weight is "0.5" is placed immediately following the extra subfield SFex2. The extra subfields SFex1 and SFex2 each comprise an address period TA and a sustain period TS. The number of sustain pulses in the extra subfield SFex1 whose luminance weight is "0.5" is chosen to be one half of that in the subfield SF1 whose luminance weight is "1", while the number of sustain pulses in the extra subfield SFex2 whose luminance weight is "0.25" is chosen to be one quarter of that in the subfield SF1 whose luminance weight is "1".

As shown in FIG. 18, the extra subfield SFex2 whose luminance weight is "0.25" is always ON except when the input luminance level is level 0, and the extra subfield SFex1 whose luminance weight is "0.5" is always ON except when the input luminance level is level 0 or 1 (i.e., the output luminance level is 0 or 0.25). As for the other eight subfields SF1 to SF8, as the input luminance levels of 0 to 255 are shifted to the levels of 1 to 257 (255) by the shift circuit 3131 described with reference to FIG. 8, the output luminance level defined by the combination of the extra subfields SFex1 and SFex2 and subfields SF1 to SF8 changes from 0 to 0.25, to 0.75, to 1.75, . . . , to 253.75 as the input luminance level successively increases from 0 to 1, to 2, to 3, to 255. Since this is equivalent to increasing the number of grayscale levels by 2 for the low luminance portion, the grayscale display capability is equivalently quadrupled. Otherwise, the grayscale display capability is substantially the same as that achieved in the prior art since the luminance step is the same, though the output luminance level is reduced by 1.25.

Figure 19:
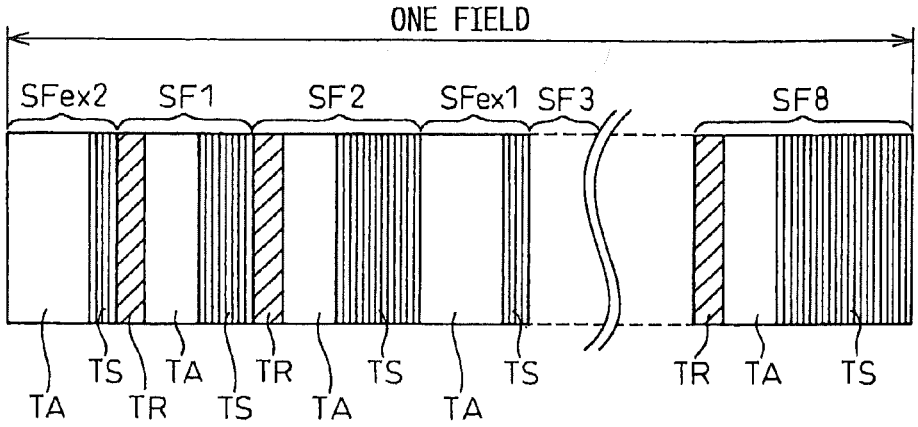
FIG. 19 illustrates an exemplary grayscale driving sequence according to a fifth embodiment of the display apparatus driving method of the present invention.

FIG. 19 illustrates an exemplary grayscale driving sequence according to a fifth embodiment of the display apparatus driving method of the present invention.

As is apparent from a comparison between FIG. 19 and FIG. 17, the extra subfield SFex1 in the foregoing fourth embodiment is placed after the subfield SF2 in the fifth embodiment. That is, the extra subfield SFex2 whose luminance weight is "0.25" is set as the first subfield to be turned ON in the one field, and the extra subfield SFex1 whose luminance weight is "0.5" is inserted between the subfield SF2 and the subfield SF3.

In this way, the number of extra subfields is not limited to 1, and the extra subfield need not necessarily be set as the first subfield to be turned ON in the one field but may be inserted at any position within the one field.

As described above, according to each embodiment of the present invention, by adding the subfield(s) (the extra subfields SFex, SFex1, SFex2) having a luminance lower than the lowest luminance (luminance weight "1" for the subfield SF1) in the subfield group (SF1 to SF8) usually used to represent the grayscale, the grayscale display capability for the low luminance portion can be enhanced, while suppressing an increase in the time required for driving. Further, according to each embodiment of the present invention, since the reset period TR in the extra subfield can be omitted, the brightness of the background can be maintained at the same level as the prior art, and the contrast does not degrade.

The embodiments of the present invention have been described above, based on the driving sequence that drives the plasma display panel by using the eight subfields SF1 to SF8 representing 256 grayscale levels, but the present invention is not limited in application to the driving sequence in which the eight subfields SF1 to SF8, each having a luminance weight expressed as a power of 2, are arranged in the order of luminance weight, rather, the invention can be applied widely to various other driving sequences, including, for example, a driving sequence that has a plurality of subfields having the same weight and a driving sequence in which the subfield arrangement is devised so as to prevent false contouring, etc.

As described above, according to the present invention, the grayscale display capability for the low luminance portion can be enhanced, while suppressing an increase in the time required for driving. Furthermore, it becomes possible to prevent the address discharge from becoming difficult to occur in a cell, by not allowing a long time to elapse from the immediately preceding discharge produced in the cell.

The present invention can be applied widely to field time division type display apparatuses, including plasma display apparatuses, in which one field is divided into a plurality of subfields, each comprising a reset period, an address period, and a sustain period, and grayscale is displayed by combining these subfields, for example, the invention can be applied widely to display apparatuses such as those used for personal computers, workstations, etc. or those used as hang-on-the-wall televisions or as apparatuses for displaying advertisements, information, etc., and to driving methods for such display apparatuses.

The embodiments can be implemented in computing hardware (computing apparatus) and/or software, such as (in a non-limiting example) any computer that can store, retrieve, process and/or output data and/or communicate with other computers. The results produced can be displayed on a display of the computing hardware. A program/software implementing the embodiments may be recorded on non-transitory computer-readable media comprising computer-readable recording media. Examples of the computer-readable recording media include a magnetic recording apparatus, an optical disk, a magneto-optical disk, and/or a semiconductor memory (for example, RAM, ROM, etc.). Examples of the magnetic recording apparatus include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW.

Further, according to an aspect of the embodiments, any combinations of the described features, functions and/or operations can be provided.

The many features and advantages of the embodiments are apparent from the detailed specification and, thus, it is intended by the appended claims to cover all such features and advantages of the embodiments that fall within the true spirit and scope thereof. Further, since numerous modifications and changes will readily occur to those skilled in the art, it is not desired to limit the inventive embodiments to the exact construction and operation illustrated and described, and accordingly all suitable modifications and equivalents may be resorted to, falling within the scope thereof.

What is claimed is:

1. A driving method for a plasma display apparatus having address electrodes, scan electrodes and common electrodes and displaying one field of image by using a plurality of subfields, wherein one specific subfield is arranged to be turned ON early in the one field and turned ON at all input luminance levels, which correspond to each pixel, being higher than input luminance level "0", the specific subfield has a least luminance weight and does not have a resetting period, and a preprocessing placed before an addressing period is provided in the specific subfield and a waveform having a voltage value decreasing with time is applied in the preprocessing.

2. The driving method for a plasma display apparatus according to claim 1, wherein the specific subfield is arranged as a first subfield of the plurality of subfields to be turned ON in the one field.

3. The driving method for a plasma display apparatus according to claim 1, wherein the specific subfield is arranged as a second subfield of the plurality of subfields to be turned ON in the one field.

4. The driving method for a plasma display apparatus according to claim 1, wherein a waveform having a voltage value decreasing with time is applied in the preprocessing without applying a waveform having a voltage value increasing with time to be applied in a resetting period in a subfield other than the specific subfield.

5. The driving method for a plasma display apparatus according to claim 2, wherein a waveform having a voltage value decreasing with time is applied in the preprocessing without applying a waveform having a voltage value increasing with time to be applied in a resetting period in a subfield other than the specific subfield.

6. The driving method for a plasma display apparatus according to claim 3, wherein a waveform having a voltage value decreasing with time is applied in the preprocessing without applying a waveform having a voltage value increasing with time to be applied in a resetting period in a subfield other than the specific subfield.

7. The driving method according to claim 1, wherein the specific subfield does not have a sustaining period.

8. The driving method according to claim 2, wherein the specific subfield does not have a sustaining period.

9. The driving method according to claim 3, wherein the specific subfield does not have a sustaining period.

* * * * *